US010427406B2

(12) United States Patent
Clark et al.

(10) Patent No.: US 10,427,406 B2
(45) Date of Patent: Oct. 1, 2019

(54) PRINT BAR SENSORS

(71) Applicant: Hewlett-Packard Development Company, L.P., Houston, TX (US)

(72) Inventors: Garrett E. Clark, Corvallis, OR (US); Michael W. Cumbie, Corvallis, OR (US); Jeremy Sells, Corvallis, OR (US); Mark H. MacKenzie, Vancouver, WA (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/772,344

(22) PCT Filed: Feb. 5, 2016

(86) PCT No.: PCT/US2016/016781

§ 371 (c)(1),
(2) Date: Apr. 30, 2018

(87) PCT Pub. No.: WO2017/135966

PCT Pub. Date: Aug. 10, 2017

(65) Prior Publication Data

US 2018/0326728 A1 Nov. 15, 2018

(51) Int. Cl.

| | |
|---|---|
| ***B41J 2/155*** | (2006.01) |
| ***B41J 29/38*** | (2006.01) |
| ***B41J 29/393*** | (2006.01) |
| ***B41J 2/14*** | (2006.01) |
| ***B41J 11/00*** | (2006.01) |
| ***B41J 13/32*** | (2006.01) |
| ***B41J 2/21*** | (2006.01) |

(52) U.S. Cl.

CPC ..... *B41J 2/155* (2013.01); *B41J 2/14153* (2013.01); *B41J 2/14201* (2013.01); *B41J 2/2135* (2013.01); *B41J 2/2146* (2013.01); *B41J 11/007* (2013.01); *B41J 11/0095* (2013.01); *B41J 13/32* (2013.01); *B41J 29/38* (2013.01); *B41J 29/393* (2013.01); *B41J 2202/20* (2013.01)

(58) Field of Classification Search

CPC .... B41J 2/155; B41J 2/14153; B41J 2/14201; B41J 29/38; B41J 29/393; B41J 2202/20

See application file for complete search history.

(56) References Cited

U.S. PATENT DOCUMENTS

| | | | |
|---|---|---|---|
| 5,746,521 | A | 5/1998 | Schoen et al. |
| 6,371,591 | B1 | 4/2002 | Conta et al. |
| 6,450,614 | B1 | 9/2002 | Scheffelin et al. |
| 6,491,375 | B1 | 12/2002 | Fitch |
| 6,794,725 | B2 | 9/2004 | Lemmi et al. |
| 7,673,969 | B2 | 3/2010 | Hoisington et al. |

(Continued)

FOREIGN PATENT DOCUMENTS

| | | |
|---|---|---|
| CN | 101480875 | 7/2009 |
| CN | 102905903 | 1/2013 |

(Continued)

*Primary Examiner* — Henok D Legesse
(74) *Attorney, Agent, or Firm* — HP Inc.

(57) ABSTRACT

The present disclosure includes a description of an example print bar that includes an ejection die disposed on a support element, and a sensor disposed at a particular location on the support element.

12 Claims, 4 Drawing Sheets

(56) References Cited

U.S. PATENT DOCUMENTS

| | | | | |
|---|---|---|---|---|
| 2004/0085385 | A1 | 5/2004 | Arquilevich et al. | |
| 2004/0263860 | A1 | 12/2004 | Johnson | |
| 2007/0024647 | A1 | 2/2007 | Cowan et al. | |
| 2009/0058921 | A1* | 3/2009 | Habashi | B41J 2/16585 347/29 |
| 2014/0210886 | A1 | 7/2014 | Driggers et al. | |
| 2016/0001558 | A1 | 1/2016 | Chen et al. | |
| 2016/0339695 | A1* | 11/2016 | Chen | B41J 2/14032 |

FOREIGN PATENT DOCUMENTS

| | | |
|---|---|---|
| EP | 1245398 | 10/2002 |
| EP | 2033791 | 3/2009 |
| JP | 2009015228 | 1/2009 |
| WO | WO-2014133633 | 9/2014 |
| WO | WO-2015116073 | 8/2015 |
| WO | WO-2015185149 A1 | 12/2015 |

* cited by examiner

PRINT BAR SENSORS

BACKGROUND

Printing systems include devices and mechanisms, such as printheads and print engines, for generating a printed image on print media. Such systems can also include devices and mechanisms for detecting and aligning the print media and for detecting or measuring print characteristics of the printed image on the print media.

DETAILED DESCRIPTION

Implementations of the present disclosure include print bars for use in printing systems. Such print bars can include multiple inkjet dies, also referred to herein as ejection dies, disposed across them for use in page wide array printing systems. Accordingly, print bars described herein can be used to print one or more printing materials along the full width of a print media in a single pass.

To aid in the fast and efficient alignment and quality detection of printed images generated by such print bars, various examples include sensors disposed on the print bar that can detect various print media presence or orientation as well as print characteristics of the ejection dies. In one implementation, the print bar can include multiple sensors disposed along the width of the print bar to help detect the print characteristics of regions printed by the ejection dies that have overlapping print nozzle arrays. In such implementations, the print bars can also include various devices or logic for controlling the ejection dies and sensors. With the ejection dies and sensors disposed on the print bar, a service station of the printing system in which the print bar is installed can service and/or clean excess or inadvertently deposited printing material from the surface of the ejection dies and the sensors.

The print bar can also include various electronic connection elements and mechanical connection elements by which the ejection dies and the sensors can be coupled to a controller in the printing system. By sharing the electronic connection and the mechanical connections on the print bar, the sensors can be included in the printing system without additional connections or mounts. Similarly, by utilizing the service station already included in the printing device for cleaning the ejection dies, the sensors can be cleaned without the addition of an additional service station. In addition, the relative close orientation of the sensors and ejection dies on a single print bar provides for a less complex and less costly print media handler that maintains precise alignment in only one region of the printing system, such as the print zone. Such characteristics of the print bar described herein can help reduce the cost and complexity of printing systems in which they are used.

Figure 1:
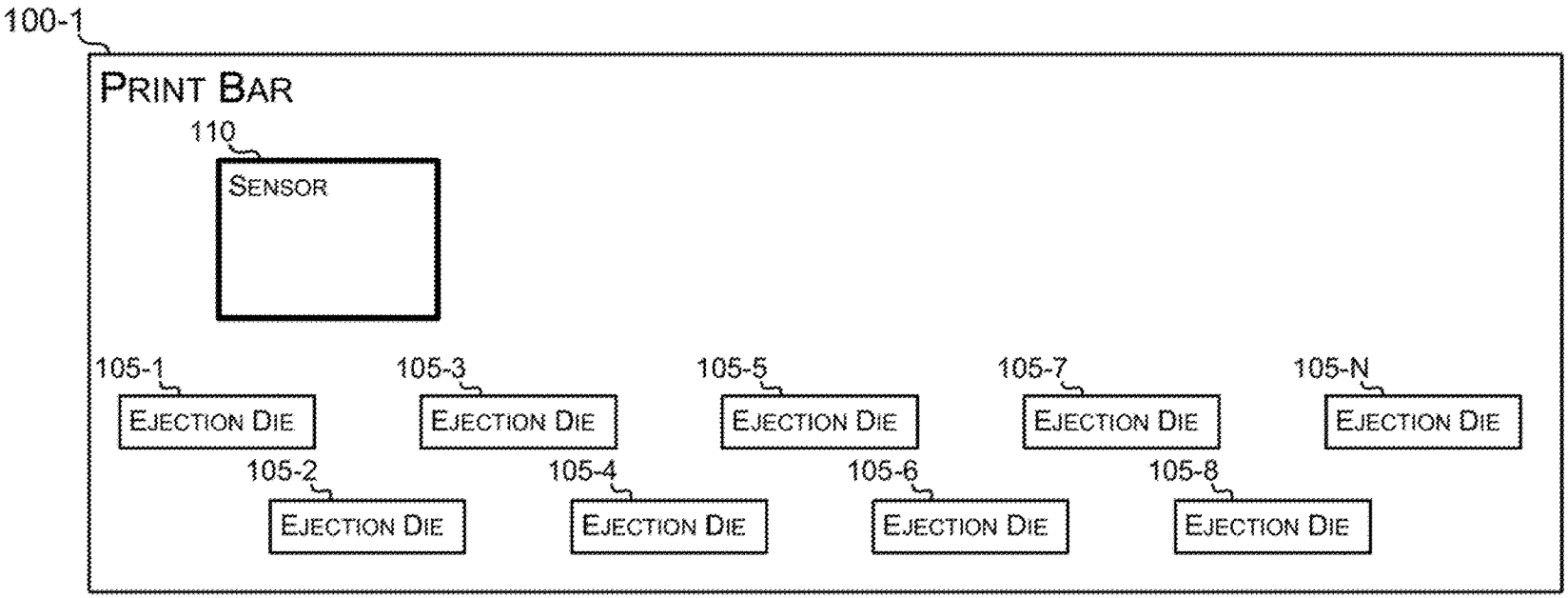
FIG. 1 depicts a schematic representation of an example print bar.

FIG. 1 is schematic diagram of an example print bar 100-1 according to various implementations of the present disclosure. As shown, the print bar 100-1 can include multiple ejection dies 105. In the example illustrated, the print bar 100-1 includes N, where N is an integer, ejection dies 105. As such, the print bar 100-1 may include one ejection die (e.g., N=1). The ejection dies can include a corresponding array of print nozzles from which a coordinated pattern of the print material droplets can be ejected to form a printed image. The print nozzles can include various types of inkjet nozzles, such as piezoelectric inkjet nozzles and/or thermal inkjet nozzles. In some implementations, each one of the ejection dies 105 can be formed using a corresponding manufacturing process, such as a semiconductor manufacturing process, mechanical manufacturing process, optical manufacturing process and the like.

In some implementations, the ejection dies 105 can be disposed and arranged along a dimension (e.g., length or width) of a support element or housing of the print bar. The housing of the print bar can include various types of metals, plastics, composites, etc. In some implementations, the housing of the print bar can been an injected molded part that includes reservoirs and channels for delivering printing material to the print nozzles in the ejection dies 105. In various implementations, the ejection dies 105 can be disposed on a support element. The support element can be incorporated into the housing of the print bar and be arrange along one of the dimensions of the print bar 100.

In implementations, the housing of the print bar 100 can include an over-molded plastic element in which the ejection dies 105 can be disposed and held in place relative to one another and the other components of the print bar 100-1. In one particular example, the over-molded part can be disposed around an arrangement of the ejection dies 105 on a support element of the print bar and flowed to mold around the dies. In such implementations, the print bar can also include a sensor 110 disposed in the over-molded part. Accordingly, the ejection dies 105 and the sensor 110 can be arranged and then disposed in the over-molded part of the housing of the print bar by flowing the over-molding material around the parts and a support element. The orientation or arrangement of the sensor 110 and the ejection dies 105 can depend on the dimensions of the ejection dies 105 and/or the sensor 110. In related implementations, the orientation or arrangement of the sensor 110 and the ejection dies can depend on the dimensions of the print bar 100, the printing device, or print engine in which the print bar 100-1 will be used.

The sensors 110 can include various imaging (e.g., digital camera) or optical/photo detectors (e.g., photodiodes). The sensors 110 can be operated to detect various conditions and operations of the printing system (e.g., a printer, a digital printing press, etc.) in which the print bar 100 is included. For example, the sensor 110 can be operated to sense the edges of print media, sense the location of printed blocks or lines used for the alignment of the ejection dies 105 and/or multiple print bars 100, or sense the color and/or density of printed images for the calibration of color or density performance of the ejection dies 105.

Figure 2:
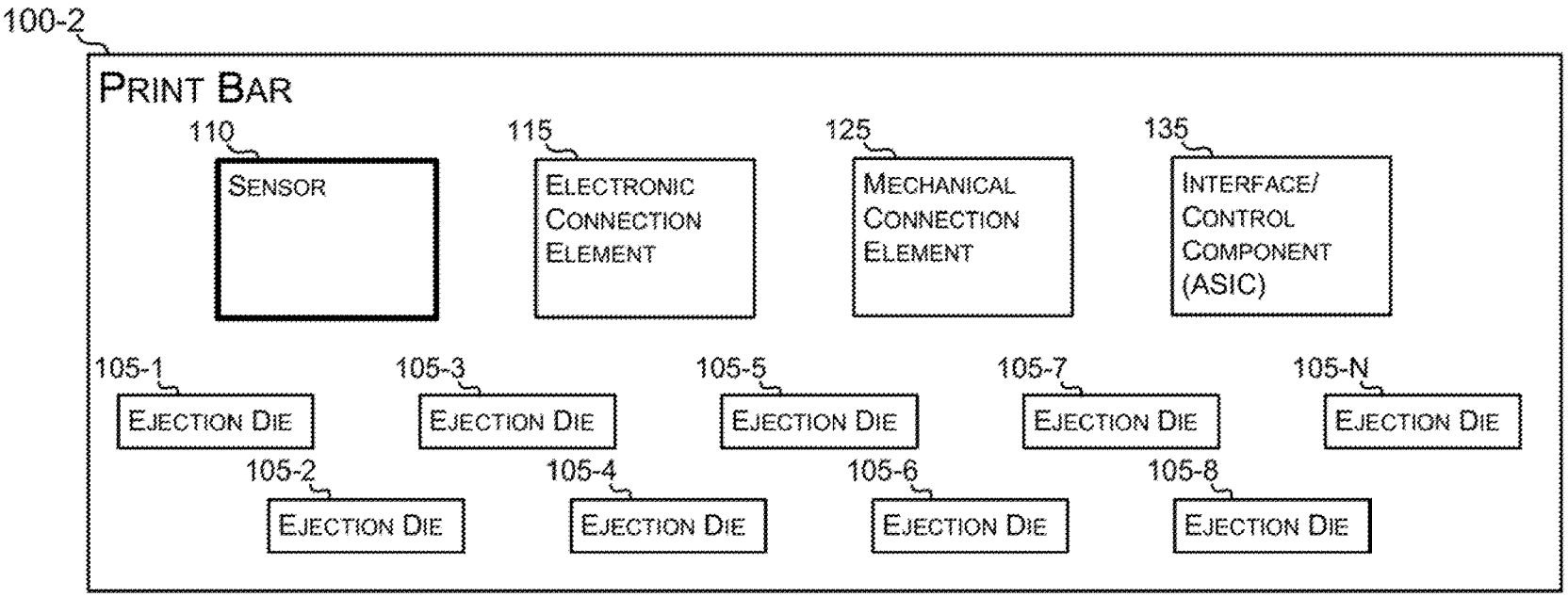
FIG. 2 depicts a perspective view of an example printhead temperature compensation system.

In implementations of the present disclosure, a print bar 100 can include not only multiple ejection dies 105, but other electronic and mechanical components used to couple the print bar 100 to a printing device or system in which it is disposed. FIG. 2 depicts one example print bar 100-2 that can include a sensor 110, electronic connection element 115, mechanical connection element 125, or interface/control component 135. The electronic connection element 115, mechanical connection element 125, or the interface/control component 135 can be integrated into the print bar 100-2. In some implementations, the subcomponents of the print bar 100-2 can be included in the molding process or the over-molding process. The subcomponents, such as the electronic connection element 115, mechanical connection element 125, the interface/control component 135 can be fixed in position relative to the other components of the print bar 100-2 in the same over-molding process used to arrange and fix the ejection dies 105-1 relative to the sensor 110.

As described herein, electronic connection element 125 can include various electrical connections for sending and receiving electronic signals and electric power to and from the various subcomponents of the print bar 100-2. For example, electronic connection element 115 can include terminals and connectors for receiving control signals from a controller in the printing system in which the print bar 100-2 is disposed for operating the ejection dies 105, the sensor 110, and/or the interface/control component 135. Accordingly, any or all of the subcomponents of the print bar 100-2 can make use of the electrical inputs and outputs provided by the electronic connection element 115 to communicate with other components of the printing system in which the print bar is included. Use of the common electronic connection element 115 can reduce the number of parts and cost associated with using a print bar 100-2 in a printing system. In addition, if the interface/control component 135 includes an application specific integrated circuit (ASIC), then functionality or logic for operating the various subcomponents of the print bar 100-2, such as the sensor 110, and/or ejection dies 105, can be included in the ASIC. Similarly, when used in combination with the appropriate logic or functionality included in the interface/control component 135, the sensor 110 can be operated to use the datum systems on the print bar 100-2 and/or the ejection dies 105 f alignment of or sensor 110.

Mechanical connection element 125 can include various mechanical registration, alignment, locking, or structural elements for fastening the print bar 100-2 into the printing system in which it is disposed. In various examples, the mechanical connection element 125 can include mounting features (e.g., clips, latches, holds, stops, etc.) that match of correspond to mounting features (e.g., clips, latches, holds, stops, etc.) in the printing system in which it is to be used. In addition, mechanical connection element 125 can include the housing and/or the over-molded element that maintains the relative physical orientation of the various subcomponents of the print bar 100-2.

Figure 3:
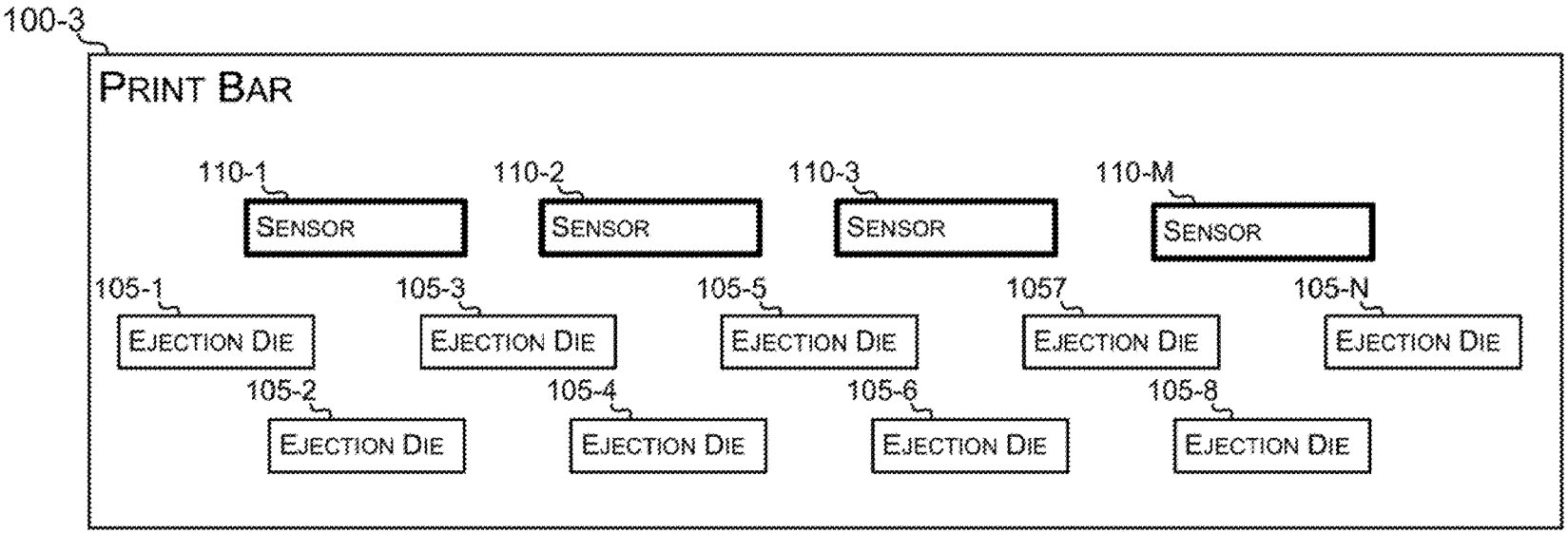
FIG. 3 is a flowchart of an example method for printhead temperature compensation.

FIG. 3 depicts another example print bar 100-3 which includes multiple sensors 110 and multiple ejection dies 105. While not shown in FIG. 3 the print bar 100-3 can also include the electronic connection element 115, mechanical connection element 125, or interface/control component 135. In such implementations, the sensors 110 can be disposed in the over-molded portion of the print bar 100-3 in arrangements to detect printed image characteristics associated with various individual ejection dies 105 and/or groups of ejection dies 105. For example, the sensors 110 can be arranged across the print bar 100-3 in a position parallel to the arrangement of a page wide array of ejection dies 105 to form a page wide sensor. Such page wide sensors can be used to continually or intermittently measure the alignment, color and/or density of the printed images generated by the ejection dies 105. As such, the sensors 110 can be used in combination to sense the various positional, alignments, or printing performance of the printing system in which the print bar 100-3 is disposed in a zone corresponding to the print zone in which the ejection dies 105 eject or deposit printing material. Such an arrangement can allow for use of a single tightly aligned print and color, density, or alignment feedback zone, instead of a print zone, scanned zone, or user intervention to use a scanner in a multi-function or all-in-one device (e.g., a combination scan, print, fax, scan type device).

In some example implementations, the sensors 110 can be included at selected locations along a dimension of the print bar 100-3 to reduce the number of sensors 110 necessary. For example, a sensor 110 can be positioned at the extreme ends of the array of ejection dies 105. Such an arrangement can enable the print bar 100-3 to do alignment measurements, similarly, the number of sensors 110 and be reduced in a print bar 100-3 if there disposed in a location to detect the regions in which adjacent ejection dies 105 overlap to measure/detect color or density print characteristics in those regions.

Figure 4:
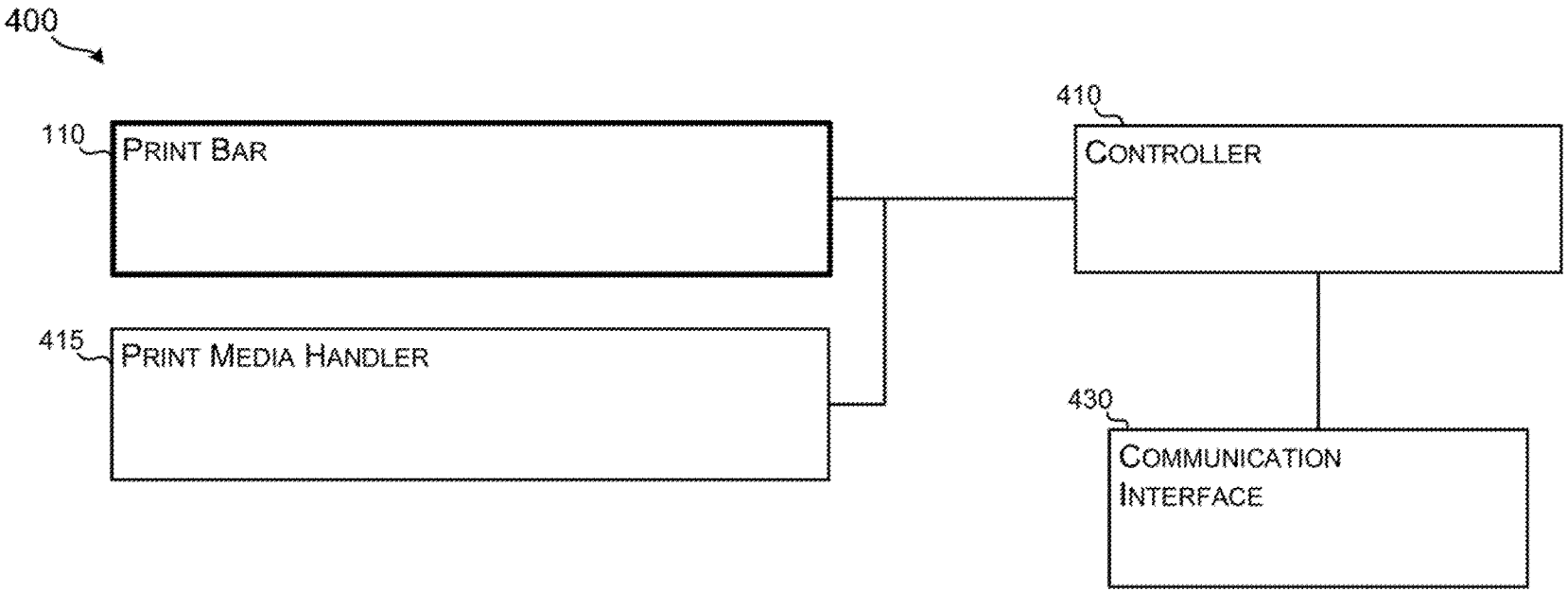
FIG. 4 example method for printhead temperature compensation.

FIG. 4 depicts a printing system 400 that includes a print bar 110 according to various implementations of the present disclosure. As shown, the printing system 400 can include the print bar 110, a print media handler 415, and the communication interface 430, each of which can be coupled to a controller 410. In the example shown in FIG. 4, the print bar 110 can represent multiple print bars 110 (e.g., the printing system 400 can include multiple print bars 110).

In various example printing system is 400, the controller 410 can include functionality and/or logic for generating and receiving electronic signals to and from the various other components of the printing system 400. For example, the controller 410 can include functionality for sending and receiving signals to the print bar 110 to control the operation of the various subcomponents of the print bar 110. As such, the control signals sent by the controller 410 to the subcomponents of the print bar 110 can cause the ejection dies 105 two eject printing material in a coordinated way to generate a printed image. Similarly, the control signal sent by the controller 400 tend to the subcomponents of the print bar 110 can cause sensor 110 to make various alignment, color, or density type measurements.

In various implementations described herein, the controller 210 can be implemented as any combination of hardware and executable code. For example, the functionality of the controller 210 described herein can be implemented as executable code executed in a processor of computer system or other computing device.

The executable code, stored on a nonvolatile computer readable medium, can include instructions for operations that when executed by a controller 210 causes the controller 210 to implement the functionality described in reference to the controller 210 and/or its subcomponents. Accordingly, controller 210 can be implemented in a system comprising a processor, a memory, a communication interface, and/or other digital or analog logic circuits that can be used to store and/or execute operations defined by executable code or code segments.

The processors of the system may be a microprocessor, a micro-controller, an application specific integrated circuit (ASIC), or the like. According to an example implementation the processor is a hardware components, such as a circuit.

As described herein, any of the control signals sent by the controller 400 tend to the print bar 100 can be handled by the electronic connection element 115. The control of the functionality of the various subcomponents of the print bar 100 can also be handled by the interface/control component 135 in response to a particular control signal sent by the controller 410. As such, various functionality of the print bar 100 described herein can be implemented as any combination of computer executable code or code segments and hardware distributed between the controller 410 and the interface/control component 135.

The print media handler 415 can also receive control signals that the controller 410 to pull, move, position, or align print media, such as paper, card stock, film, or the like, relative to the print bar 100. The print media handler 415 can, for example, include various rollers, grabbers, conveyor belts, or servomotors. In such implementations, the controller 410 can use information received from the sensor 110 in the print bar 100 as feedback to improve, calibrate or line the relative motion of the elements of the print media handler 415. In some implementations, the print media handler 415 can include or be associated with a print bar service station they can include various components for cleaning or removing unintentionally deposited printing material on the ejection dies 105 and/or the sensor 110. In such implementations in which the ejection dies 105 and sensors 110 are disposed in the same print bar 100, the same service station can be used for cleaning both the ejection dies 105 and the sensors 110, thus, eliminating the inclusion of an individual service stations and/or cleaning protocols for the sensors 110 and/or the ejection dies 105 individually.

The communication interface 430 can use the various communication media and protocols for sending and receiving electronic communication signals or data between the printing system 400 and another computing device, such as a tablet computer, laptop computer, desktop computer, and the like. As such, the communication interface 430 can include any type of wired or wireless communication media or protocol for receiving print data from which a printed image can be generated using the print bar 110 or sending feedback data to another computing device to indicate the status of the printing system 400.

These and other variations, modifications, additions, and improvements may fall within the scope of the appended claims(s). As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise. All of the features disclosed in this specification (including any accompanying claims, abstract and drawings), and/or all of the elements of any method or process so disclosed, may be combined in any combination, except combinations where at least some of such features and/or elements are mutually exclusive.

What is claimed is:

1. A page wide print bar comprising:

a plurality of ejection dies disposed along a longitudinal dimension of the page-wide print bar on a support element; and a plurality of discrete sensors disposed at corresponding positions spaced from each other along the dimension of the support element, each sensor positioned to sense print characteristics of an image printed in an overlapping print zone on a print media that corresponds to two adjacent ejection dies of the plurality of ejection dies.

2. The page wide print bar of claim 1 wherein at least some of the sensors each takes the form of an optical sensor to detect a print characteristic of two of the ejection dies.

3. The page wide print bar of claim 1 wherein the support element comprises an over-molded element.

4. The page wide print bar of claim 1 further comprising an electrical connection element coupled to the ejection dies and the sensors.

5. The page wide print bar of claim 4 further comprising a control component coupled to the ejection dies and the sensors.

6. The page wide print bar of claim 1 further comprising a mechanical connection element to couple the ejection dies and the sensors to a printing system.

7. A printing system comprising:

a print bar comprising:

a plurality of ejection dies disposed across a dimension of a support element; and a plurality of sensors disposed across the dimension of the support element to sense print characteristics of an image printed in a corresponding print zone;

a print media handler to align print media in the print zone;

a controller to receive sensor signals from the plurality of sensors and generate control signals to control the plurality of ejection dies; and a shared service station to clean both the plurality of ejection dies and the plurality of sensors.

8. The printing system of claim 7 wherein the plurality of sensors are disposed at corresponding positions to sense the print characteristics of the image deposited by two adjacent election dies in the plurality of ejection dies.

9. The printing system of claim 8 wherein the positions correspond to regions in which the two adjacent ejection dies overlap.

10. The printing system of claim 7 wherein the print bar further comprises an application specific integrated circuit (ASIC) comprising logic to control the plurality of ejection dies or the plurality of sensors.

11. The printing system of claim 7 wherein the print bar comprises a mechanical connection element corresponding to mounting features in the printing system.

12. The printing system of claim 7 wherein the print bar further comprises an electronic connection element coupled to the plurality of ejection dies and the sensor and the controller.

* * * * *